US006079974A

United States Patent [19]

Thompson

[11] Patent Number: 6,079,974

[45] Date of Patent: Jun. 27, 2000

[54] COMBUSTION CHAMBER TO ACCOMMODATE A SPLIT-STREAM OF RECYCLED GASES

[75] Inventor: Stanley P. Thompson, Topeka, Kans.

[73] Assignee: Beloit Technologies, Inc., Wilmington, Del.

[21] Appl. No.: 08/949,343

[22] Filed: Oct. 14, 1997

[51] Int. Cl.[7] ..... F23C 5/32; F23M 3/00; F23D 1/02

[52] U.S. Cl. ..... 431/173; 431/9; 431/2; 431/116; 431/10; 110/264; 110/104 R

[58] Field of Search ..... 431/5, 173, 116, 431/115, 10, 2, 353, 158, 9; 60/750; 110/345, 295, 204, 210, 264, 263, 104 R

[56] References Cited

U.S. PATENT DOCUMENTS

| | | | |
|---|---|---|---|
| 2,560,074 | 7/1951 | Bloomer . | |
| 2,823,628 | 2/1958 | Poole et al. . | |
| 2,985,438 | 5/1961 | Prowler . | |
| 3,048,215 | 8/1962 | Huckabee . | |
| 3,145,076 | 8/1964 | Reichert et al. . | |
| 3,194,215 | 7/1965 | Barnes | 431/5 |
| 3,560,165 | 2/1971 | Beasley | 431/5 |
| 3,804,578 | 4/1974 | Robbins . | |
| 3,861,055 | 1/1975 | Thompson . | |
| 4,060,378 | 11/1977 | Peredi | 431/10 |
| 4,120,640 | 10/1978 | Martin . | |
| 4,427,362 | 1/1984 | Dykema | 431/10 |
| 4,526,529 | 7/1985 | Bernard et al. . | |
| 4,879,959 | 11/1989 | Korenberg . | |
| 5,013,236 | 5/1991 | Khinkis | 431/10 |
| 5,102,328 | 4/1992 | Robinson | 431/116 |
| 5,562,442 | 10/1996 | Wilhelm | 431/5 |

FOREIGN PATENT DOCUMENTS

| | | | |
|---|---|---|---|
| 0073265 | 9/1983 | European Pat. Off. | 431/10 |
| 1501907 | 1/1970 | Germany . | |

*Primary Examiner*—Ira S. Lazarus
*Assistant Examiner*—David Lee
*Attorney, Agent, or Firm*—Shook, Hardy & Bacon LLP

[57] ABSTRACT

A combustion chamber is provided that has a vertically oriented body with an inner surface defining an inner combustion area. A burner is disposed adjacent one end of the body so that the flame of the burner when lit will extend into the combustion area. A first annular insert is disposed in the combustion area and generally surrounds the flame of the burner. The annular insert defines a first secondary gas introduction zone for introducing secondary gases into the combustion area so that the secondary gases can be oxidized by the burner flame. The insert has an inner surface presenting at least one opening for allowing fluid communication between the introduction zone and the combustion area. A second annular insert is disposed in the combustion area below the first insert. The second insert defines a secondary gas extraction zone and a second secondary gas introduction zone located below the extraction zone. The gas extraction zone and second secondary gas introduction zone are separated by a divider plate. The gas extraction zone and second secondary gas introduction zone are generally separated by an annular inner wall which has openings therein to allow fluid communication between the combustion area and the extraction zone and second secondary gas introduction zone.

24 Claims, 4 Drawing Sheets

COMBUSTION CHAMBER TO ACCOMMODATE A SPLIT-STREAM OF RECYCLED GASES

BACKGROUND OF THE INVENTION

This invention relates to a combustion chamber for supplying heated gases to a device in which a material is dried and/or heated, and more specifically, to a combustion chamber that accommodates a split-stream of recycled gases.

Drying systems are important features in the manufacture and processing of many different materials. For example, drying systems are often used in drying wood chips during the manufacturing of particle board. Further, drying systems are of particular importance during the processing of ethanol. More particularly, after ethanol has been removed from grain during the fermentation process, it is then desirable to dry the grain to allow storage and resale of the grain for animal feed or other uses.

Typical drying systems include a combustion chamber into which natural gas and air are supplied and combusted. The heated combustion gases in the combustion chamber are then induced by a draft fan into a rotating cylindrical dryer. The material to be dried is introduced into the dryer and exposed to the current of heated gases. The dried material is then separated from the heated gas current in a cyclone separator. The remaining heated gases are then typically vented to the environment. An example of a typical drying system of the prior art is disclosed in U.S. Pat. No. 3,861,055, which is incorporated herein by reference.

A major problem with these prior art systems involves the venting of the combustion gases to the atmosphere. More particularly, these combustion gases contain various pollutants. For example, the gases oftentimes contain volatile organic compounds (VOC's), carbon dioxide ($CO_2$), particulate and nitric oxide (NO). In addition to pollutants that result from the combustion process in the combustion chamber, pollutants can also result from the drying of the material itself. For instance, in the drying of wood chips or other organic material, particulate is often contained in the combustion gases as they are vented to the atmosphere. Because governmental standards set the level of pollutants that can be vented to the atmosphere, it is often necessary to add additional pollution control devices to the drying systems to reduce the pollutant levels in the gas stream prior to venting. These devices often are add-on oxidizers which oxidize the VOC's and particulate present in the gas stream to reduce such pollutants to an acceptable level. These pollution control devices are typically expensive to install and operate.

Some prior art drying systems have attempted to address the above-discussed problem by recycling the combustion gases. More specifically, in one type of drying system, all of the combustion gases exiting the dryer are recycled back into a combustion chamber for oxidation. Gases are also taken out of the drying system at the combustion chamber and vented to the atmosphere. Recycled gases flowing into the combustion chamber and those flowing out of the combustion chamber are run through a heat exchanger wherein the heat from the gases flowing out of the combustion chamber and to the atmosphere is transferred to the recycled gases flowing into the combustion chamber. This type of drying system suffers from various disadvantages. First, because the entire quantity of combustion gases is recycled to the combustion chamber for oxidation, this drying system operates within very narrow operating parameters. More specifically, the prior art system only operates in an optimal manner at a particular capacity of the drying system. If the capacity of the drying system varies from the particular level, the oxidation temperature of the recycled gases and the inlet temperatures of the gases to the dryer could vary substantially. Because these factors could vary over large ranges, differing levels of pollutants were vented to the atmosphere depending on the capacity at which the prior art system was run. Further, again depending on the capacity, the dryer inlet temperature could vary substantially, thus resulting in inconsistent or incomplete drying of the material.

Further, these attempts to recycle gases exiting the dryer back into the combustion chamber suffer from other disadvantages. Because the recycled gases are often introduced into the combustion chamber in a haphazard and uncontrolled fashion, the gases may interfere with the operation of and efficiency of the burner flame. Furthermore, the uncontrolled introduction of recycled gases may result in incomplete and/or inconsistent oxidation of pollutants found in the recycled gases. Likewise, the removal of gases from the combustion chamber for venting to the environment has not been executed in a controlled fashion in the prior art systems. More specifically, the temperature of the gases removed from the combustion chamber was not controlled. This resulted in less than optimal efficiency of the system and is detrimental to the heat exchangers through which the vented gases will flow.

Thus, a novel combustion chamber construction is needed to overcome the drawbacks and shortcomings of prior combustion chambers. Further, a combustion chamber is needed that can oxidize pollutants within the system so that external pollution control devices are not needed. Still further, a combustion chamber is needed that will accommodate a separated recycled gas stream so that only a desired portion of the recycled gas stream is oxidized and vented to the environment. Further yet, a combustion chamber is needed that provides an avenue for removal of recycled gases after oxidation. Still further, a combustion chamber is needed that can be used to control the temperature of the gases removed by removing the gases from a desired location within the chamber.

SUMMARY OF THE INVENTION

One object of the present invention is to provide a combustion chamber construction which provides a reduction in the emission of pollutants from a drying process into the atmosphere.

Another object of the present invention is to provide a combustion chamber construction which accommodates a split stream of recycled gases so that a portion of the gases can be oxidized and vented to the environment while another portion is returned to the drying system.

A further object of the present invention is to provide a combustion chamber construction which provides a structure to remove the gases from the chamber in a desired location and temperature range.

According to one aspect of the present invention a combustion chamber is provided having a vertically oriented body with an inner surface defining an inner combustion area. A burner is disposed adjacent one end of the body so that the flame of the burner when lit will extend into the combustion area. A first annular insert is disposed in the combustion area and generally surrounds the flame of the burner. The annular insert defines a first secondary gas introduction zone for introducing secondary gases into the combustion area so that the secondary gases can be oxidized by the burner flame. The insert has an inner surface presenting at least one opening for allowing fluid communication between the introduction zone and the combustion area. A second annular insert is disposed in the combustion area below the first insert. The second insert defines a secondary gas extraction zone and a second secondary gas introduction zone located below the extraction zone. The gas extraction zone and second secondary gas introduction zone are separated by a divider plate. The gas extraction zone and second secondary gas introduction zone are generally separated by an annular inner wall which has openings therein to allow fluid communication between the combustion area and the extraction zone and second secondary gas introduction zone.

Additional objects, advantages, and novel features of the invention will be set forth in part in the description which follows and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification.

DETAILED DESCRIPTION OF PREFERRED EMBODIMENTS

Figure 2:
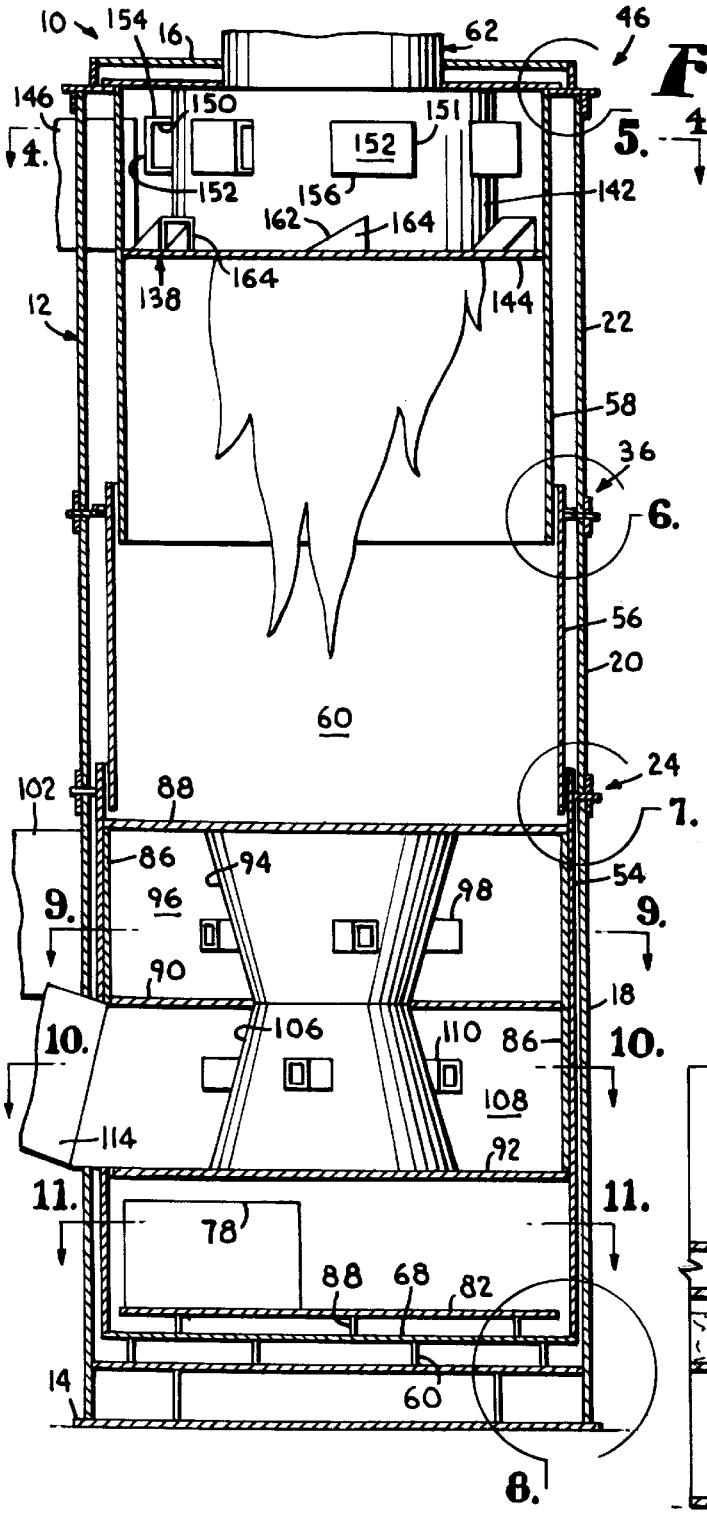
FIG. 2 is a detailed cross-sectional view of the combustion chamber of FIG. 1, parts being broken away and shown in cross-section to reveal details of construction.

A combustion chamber embodying the principles of this invention is broadly designated in the drawings by the reference numeral 10. Chamber 10 has an outer cylindrical shell 12 with a circular base 14 and a circular cover 16, as best seen in FIG. 2. Shell 12 includes a lower cylindrical wall section 18, a middle wall section 20 and an upper wall section 22.

Figure 7:
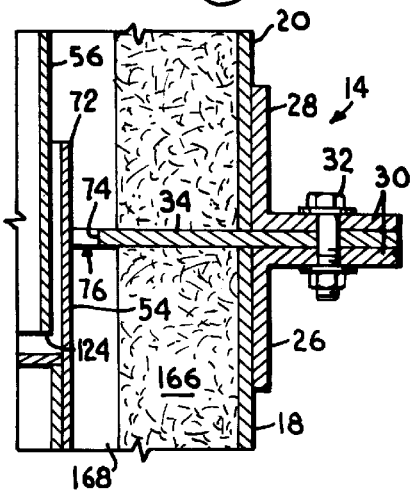
FIG. 7 is a fragmentary enlarged view of the area designated by the numeral 7 in FIG. 2 and showing the relative positions of the intermediate liner section and the lower liner section.
Figure 8:
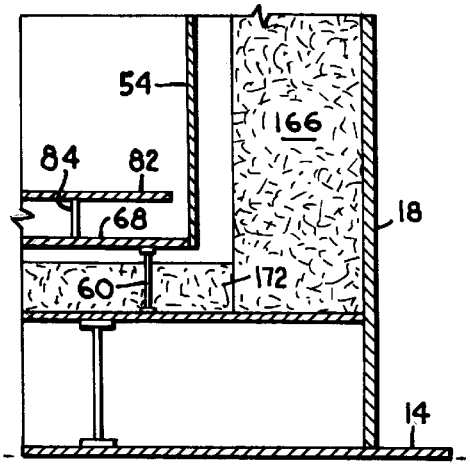
FIG. 8 is a fragmentary enlarged view of the area designated by the numeral 8 in FIG. 2.

Lower section 18 is preferably formed integrally with base 14, and extends upwardly from the periphery of base 14, as best seen in FIG. 8. Lower section 18 is connected to middle section 20 by a connecting arrangement 24 as best seen in FIGS. 2 and 7. Arrangement 24 includes a pair of annular L-shaped connecting flanges 26 and 28. Flange 26 is preferably welded to the outer peripheral surface of lower surface 18 adjacent its upper end. Flange 28 is preferably welded to the outer peripheral surface of middle section 20 adjacent its lower end. Flanges 26 and 28 each have a horizontal portion 30 which preferably have a plurality of aligned, spaced apart apertures for receiving bolts 32 to secure flanges 26 and 28 together.

Connecting arrangement 24 also serves to locate and support an abutment ring 34. Ring 34 helps to maintain the alignment of and preserve the shape of an adjacent liner section as will be further described below. Ring 34 is preferably formed of a flat annular piece of metal. Ring 34 is supported at its vertical location by positioning an outer portion of the ring between horizontal portions 30 of flanges 26 and 28, so that bolts 32 secure sections 18 and 20 together and secure ring 34 at its vertical location.

Figure 6:
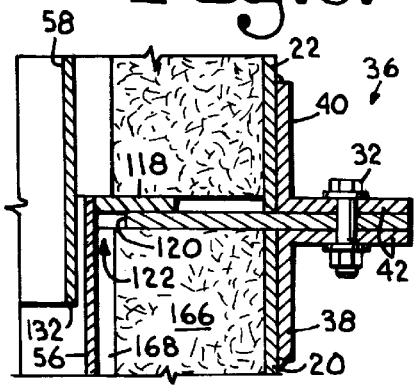
FIG. 6 is a fragmentary enlarged view of the area designated by the numeral 6 in FIG. 2 and showing the hanging arrangement of the intermediate liner section.

Middle section 20 is connected to upper section 22 by a connecting arrangement 36, as best shown in FIG. 6. Connecting arrangement 36 is similar to connecting arrangement 24. More specifically, arrangement 36 has annular L-shaped connecting flanges 38 and 40 which are identical to flanges 26 and 28 described above. Flange 38 is welded to the peripheral surface of middle section 20 adjacent its upper end and flange 40 is welded to upper section 22 adjacent its lower end. Flanges 38 and 40 each have a horizontal portion 42 which each have a plurality of aligned, spaced apart apertures for receiving bolts 32 to secure flanges 38 and 40 together. Connecting arrangement 36 is used to secure an annular support shelf 44 at a vertical location within shell 12. Shelf 44 is used to support a middle lining section, as will be more fully described below. Shelf 44 is preferably formed of a flat annular piece of metal. As with abutment ring 34, shelf 44 is secured at its vertical location by positioning an outer portion of shelf 44 between horizontal portions 42 of flanges 38 and 40. Further, shelf 44 is held in place by aligning apertures formed in the shelf with the apertures in flanges 38 and 40, and securing bolts 32 in the aligned apertures.

Figure 3:
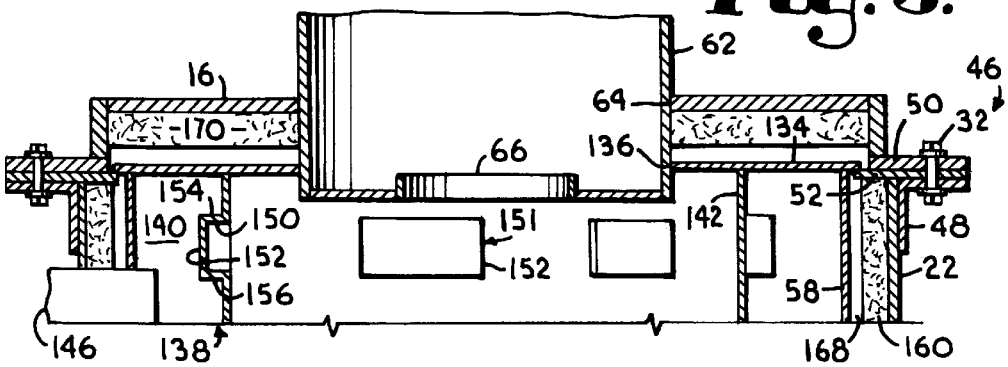
FIG. 3 is a fragmentary enlarged view similar to FIG. 1 showing the upper end of the combustion chamber.
Figure 5:
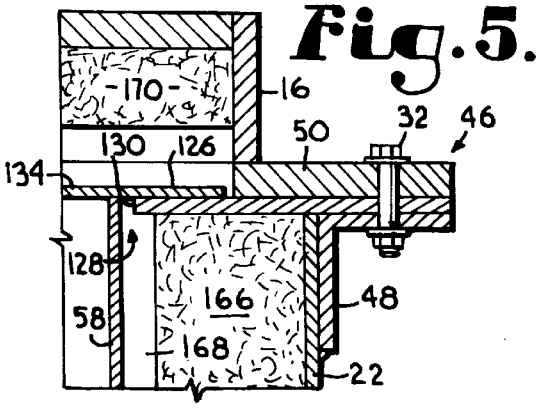
FIG. 5 is a fragmentary enlarged view of the area designated by the numeral 5 in FIG. 2 and showing the hanging arrangement of the upper liner section.

Cover 16 is secured to upper section 22 by a connecting arrangement 46, as best shown in FIGS. 3 and 5. Connecting arrangement 46 includes an annular L-shaped connecting flange 48, which is identical to flanges 26, 28, 38, and 40. Flange 48 is welded to the peripheral surface of upper section 22 adjacent its upper end. Cover 16 has an annular connecting portion 50 that is connected to the horizontal portion of flange 48 by aligning a plurality of spaced apart apertures formed in both structures and disposing bolts 32 through the aligned apertures. As with connecting arrangement 36, connecting arrangement 46 serves to secure an annular support shelf 52 at its vertical location. Shelf 52 is used to support an upper liner section, as will be more fully described below. As with shelf 44, shelf 52 is preferably made of a flat annular piece of metal. An outer portion of shelf 52 is positioned between the horizontal portion of flange 48 and connecting portion 50. Shelf 52 has a plurality of apertures which align with the apertures in both flange 48 and connecting portion 50, so that bolts 32 can be used to secure support shelf 52 at its vertical position.

Preferably, circular base 14, lower section 18, middle section 20, upper section 22, connecting flanges 26, 28 38, 40, and 48, cover 16, abutment ring 34, and support shelves 44 and 52 are all made of carbon steel.

A lower hollow cylindrical liner 54, a middle hollow cylindrical liner 56, and an upper hollow cylindrical liner 58 are concentrically received inside of cylindrical shell 12 and form a combustion area 60 in their interiors, as best shown in FIG. 2. A burner 62 is attached to the upper surface of cover 16, and is connected to an air blower and a burner fuel inlet duct (not shown). Burner 62 extends through a hole 64 in cover 16 so that a burner outlet 66 is at least partially disposed in combustion area 60 as shown in FIG. 3.

Lower liner 54 is generally cup-shaped and completely sealed along its lower end. Lower liner 54 has a circular floor 68 which rests upon supports 70 of circular base 14 as shown in FIGS. 2 and 8. The cylindrical sidewall of liner 54 extends upwardly from floor 68 to a position adjacent abutment ring 34 as best shown in FIG. 7. More specifically, the outer peripheral surface of liner 54 adjacent an upper end 72 thereof is spaced inwardly from an inner edge 74 of abutment ring 34 so that an annular space 76 is formed between lower liner 54 and inner edge 74. Abutment ring 34 maintains alignment of and reduces outward bowing of liner section 54 when the liner is subjected to elevated temperatures associated with combustion area 60.

Figure 11:
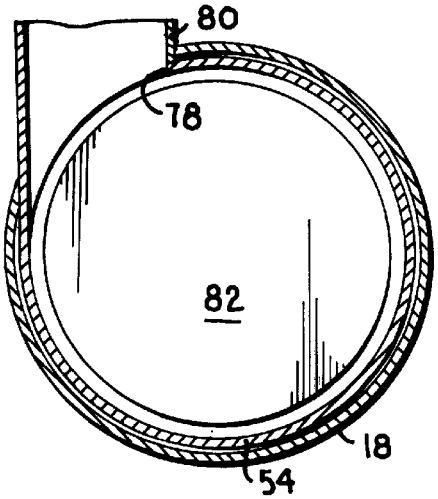
FIG. 11 is an enlarged detailed cross-sectional view taken generally along line 11—11 of FIG. 2 and showing a combustion chamber outlet port.

Lower liner 54 has an outlet port 78 formed on a portion of its sidewall, as shown in FIGS. 2 and 11. Outlet port 78 allows fluid communication between a dryer inlet duct 80 and combustion area 60, so that gases within the combustion area can be conveyed from area 60 through duct 80 and into the dryer, as more fully described below. Duct 80 extends through an opening in the sidewall of lower wall section 18 to achieve its connection with outlet port 78.

Liner section 54 can further have a removable bottom protector plate 82 shown in FIGS. 2 and 8. Plate 82 sits on braces 83 extending upwardly from floor 68. The lower portion of combustion area 60 is subject to intense radiation from the burner flame, and thus, is the area most likely to suffer thermal damage. Plate 82 generally covers floor 68 and is removable to allow easy replacement of the portion of the liner section most likely to suffer thermal damage.

Figure 9:
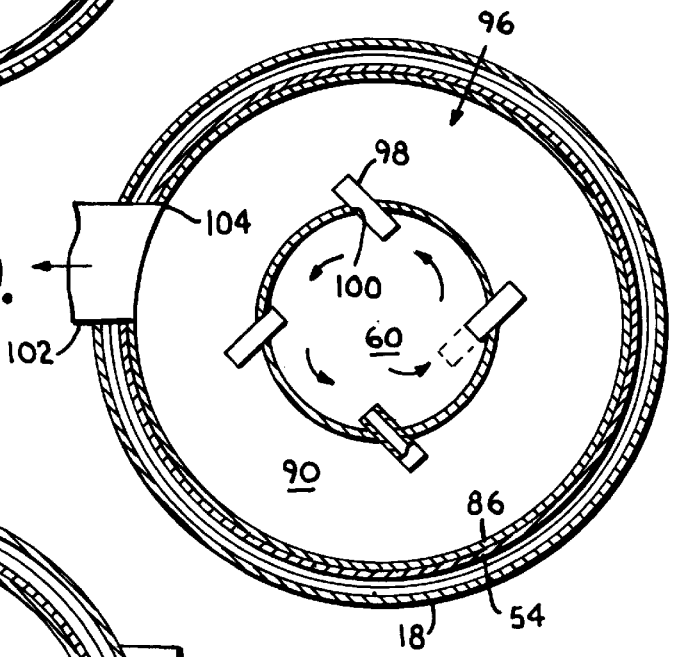
FIG. 9 is a enlarged detailed cross-sectional view taken generally along line 9—9 of FIG. 2 and showing the combustion chamber recycle vent gas zone.

Disposed within lower liner 54 and located above outlet port 78 is an insert 84. Insert 84 has an outer cylindrical wall 86 to which an annular top plate 88, an annular divider plate 90 and an annular bottom plate 92 are attached. Preferably, plates 88, 90 and 92 are attached to cylindrical wall 86 by welding. Further, insert 84 can be held within lower liner 54 with suitable attaching means, such as by welding. Connected between top plate 88 and divider plate 90 is an inner wall 94. Inner wall 94 is preferably in the shape of a truncated cone, but could be shaped differently, such as a cylindrical wall. Outer wall 86, top plate 88, divider plate 90 and inner wall 94 define a vent gas zone 96. Vent gas zone 96 is in fluid communication with combustion area 60, and more specifically, the area of combustion area 60 defined by inner wall 94 through adjustable ports 98. Ports 98 extend through openings 100 in inner wall 94. Ports 98 are shown in FIGS. 2 and 9 as being rectangular in shape, but other shapes could be used. Extending through lower wall section 18, lower liner 54 and outer cylindrical wall 86 is a vent gas duct 102. Vent gas duct 102 terminates at a vent gas outlet port 104 in outer cylindrical wall 86.

Connected between divider plate 90 and bottom plate 92 is an inner wall 106, which is preferably in the shape of a truncated cone oriented opposite to that of the truncated cone formed by inner wall 94. Alternatively, other shapes may be formed by inner wall 106, such as a straight cylindrical wall. Outer wall 86, inner wall 106, divider plate 90 and bottom plate 92 define a recycled gas introduction zone 108. Recycled gas introduction zone 108 is in fluid communication with combustion area 60 through adjustable ports 110, and more specifically with the portion of combustion area 60 defined by inner wall 106. Adjustable ports 110 extend through openings 112 in a similar fashion to adjustable ports 98. Extending through lower wall section 18, lower liner 54, and outer cylindrical wall 86 is a recycle gas duct 114 which terminates at recycle gas inlet port 116 in outer wall 86. Insert 84 allows a portion of the gases in combustion area 60 to be removed from combustion chamber 10 and also allows recycled gases to be introduced into combustion chamber 10, as is more fully described below.

Middle liner section 56 is supported or hung from support shelf 44, as best shown in FIG. 6. More specifically, the upper end of liner section 56 has an outwardly extending annular ridge 118 disposed adjacent its upper end. The lower surface of ridge 118 rests upon the upper surface of shelf 44 to support liner section 56 in a hanging fashion. Further, the outer peripheral surface of liner section 56 adjacent ridge 118 is spaced from an inner edge 120 of support shelf 44 so that an annular gap 122 is formed between shelf 44 and the outer peripheral surface of the liner. Because of the provision of this gap and because the ridge 118 is simply resting on shelf 44, and not rigidly secured thereto, middle liner 56 can freely expand outwardly when subjected to the expanded temperatures within the combustion area. More specifically, middle liner 56 will tend to expand laterally when the combustion chamber reaches elevated temperatures for extended periods of time. As this happens, annular ridge 118 simply slides outwardly along shelf 44. The liner can expand outwardly until the outer peripheral surface of middle liner 56 engages inner edge 120 of shelf 44. Thus, inner edge 120 maintains the alignment of middle liner 56 and reduces outward bowing of the liner section so that the generally circular shape thereof is maintained.

A lower end 124 of middle liner 56 is concentrically positioned within upper end 72 of lower liner 54, as shown in FIG. 7. Lower liner 54 and middle liner 56 are not, however, attached or secured to one another in any way. Thus, when elevated temperatures exist in combustion area 60, middle liner 56 is free to expand downwardly. Further, lower liner 54 is free to expand upwardly. Additionally, because of annular space 76 between lower liner 54 and inner edge 74 of abutment ring 34, lower liner 54 can expand outwardly until it engages edge 74, although this outward expansion is somewhat limited by insert 84. Further, the outer peripheral surface of middle section 56 and the inner surface of lower liner 54 are slightly spaced from one another so that when elevated temperatures exist in the combustion area the surfaces will engage to form a seal that reduces heat leakage from the combustion area.

Upper liner 58 is solely supported by or hung from support shelf 52, as best seen in FIGS. 3 and 5. More specifically, upper liner 58 has an annular ridge 126 extending outwardly from its upper end. The lower surface of ridge 126 rests on the upper surface of shelf 52 to support the liner in a hanging fashion. An annular space 128 is also provided between the outer peripheral surface of upper liner 58 adjacent ridge 126 and an inner edge 130 of shelf 52. Because of the provision of annular space 128 and because ridge 126 is not fixedly secured to shelf 52, but resting thereupon, upper liner 58 is able to expand outwardly when subjected to elevated temperatures within the combustion area. More specifically, as the temperature increases, ridge 126 can slide outwardly along shelf 52 until the outer peripheral surface of upper liner 58 engages edge 130. Thus, edge 130 serves to maintain the alignment of liner 58 and reduces outward bowing of the liner so that the generally circular shape thereof is maintained.

The lower end 132 of upper liner 58 is concentrically positioned within the upper end of middle liner 56, as shown in FIG. 6. Middle liner 56 and upper liner 58 are not attached or secured to one another in any way. Thus, upper liner 58 is free to expand downwardly when subjected to elevated temperatures. Additionally, the outer peripheral surface of upper liner 58 and the inner surface of middle liner 56 are slightly spaced from one another so that when elevated temperatures exist in the combustion area, the surfaces will engage to form a seal that reduces heat leakage from the combustion area.

Upper liner 58 further has a circular lid portion 134 extending inwardly from its upper edge to cover the upper end of the liner as best shown in FIGS. 3 and 5. Lid 134 has a hole 136 for receiving the lower end of burner 62 so that the burner outlet 66 can be disposed in combustion area 60.

Figure 4:
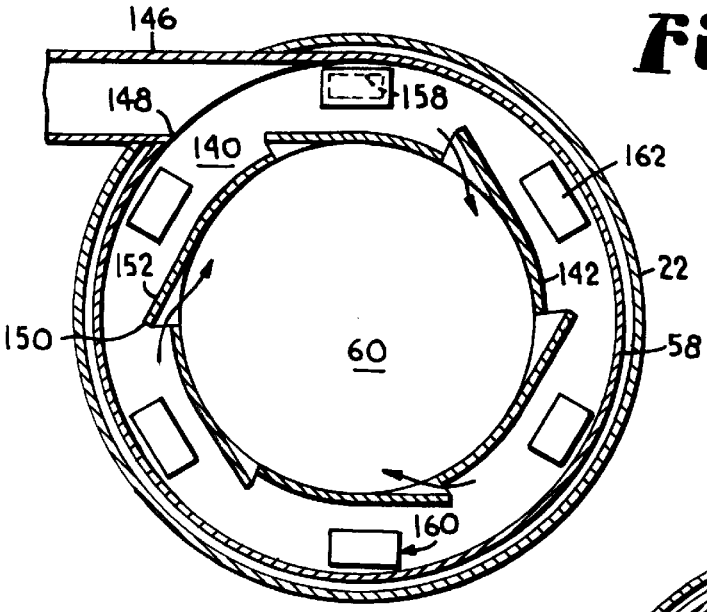
FIG. 4 is a detailed cross-sectional view taken generally along line 4—4 of FIG. 2 and showing the annular recycled gas introduction insert and the recycled gas introduction ports.

Upper liner 58 has an annular insert 138 disposed in its interior to form an annular recycle gas introduction zone 140 as best shown in FIGS. 2, 3, and 4. More specifically, insert 138 has an inner cylindrical wall 142 spaced from and concentrically received in upper liner 58. Wall 142 is attached on its upper end to lid portion 134 and extends downwardly therefrom. Insert 138 also has an annular lower plate 144 which is attached at its outer edge to upper liner 58 and at its inner edge to wall 142. Thus, zone 140 is bounded by upper liner 58, cylindrical wall 142, annular plate 144, and lid portion 134. Zone 140 completely encircles the burner flame (shown in phantom lines in FIG. 2) extending downwardly into combustion area 60 from burner 62. Zone 140 is in fluid communication with a recycled gas duct 146 via an inlet port 148. Duct 146 extends through an opening in upper wall section 22 of outer shell 12 to connect with port 148 as best shown in FIG. 4. Duct 146 is used to supply recycled gases to the combustion chamber after the gases have been separated from dried material, as will be more fully explained below. Wall 142 of insert 138 has a plurality of spaced apart, generally rectangular openings 150 which allow fluid communication between zone 140 and combustion area 60, as shown in FIGS. 2, 3, and 4. Openings 150 are defined by ports 151 extending into zone 140 from wall 142. Each port 151 has a directional plate 152 that extends into zone 140 from wall 142 and is generally tangential to wall 142, as best seen in FIG. 4. Each port also has a generally triangular upper plate 154 extending from the upper edge of directional plate 152 to wall 142 and a generally triangular lower plate 156 extending from the lower edge of plate 152 to wall 142. Thus, each opening 150 is defined by plates 152, 154, and 156 so that the opening is generally tangential to wall 142. Openings 150 formed by ports 151 allow recycled gases in zone 140 to be introduced into combustion area 60 in such a manner that the gases are directed generally tangentially to wall 142 and form a rotating film along wall 142 that extends and flows downwardly as depicted by the arrows in FIG. 4. This rotational film surrounds the burner flame.

Lower plate 144 of insert 138 also has a plurality of spaced apart generally rectangular openings 158. Openings 158 on plate 144 are formed by ports 160 extending upwardly from plate 144 into zone 140. Each port 160 includes a generally rectangular plate 162 extending upwardly from lower plate 144 and a pair of triangular side plates 164. In addition to recycled gases entering combustion area 60 through openings 150, recycled gases also enter combustion area 60 through openings 158. More specifically, because openings 158 are spaced around annular plate 144, gases will exit through the openings and into combustion area 60 to form a rotational film along the inner surfaces of liner sections 54, 56, and 58. Ports 160 direct the gases downwardly. The rotational film of recycled gases exiting openings 150 joins with the film formed by the recycled gases exiting openings 158 so that a continuous rotational film of recycled gases generally from the top of the combustion chamber downwardly.

Liner sections 54, 56, and 58; ridges 118 and 126; insert 138; and ports 148 and 160 are all preferably made of stainless steel. However, these structures could also be made of other suitable heat resistant materials. Although sections 54, 56, and 58 are described above and depicted in the figures as having a cylindrical shape, they can also be made in any other suitable shape, for example a conical or elliptical shape. Further, although annular inserts 138 and 84 are depicted in the figures as having a cylindrical shape, it also can be made in any other suitable shape, for example, a conical or elliptical shape. It being understood that the shape of inserts 138 and 84 correspond to the shape of sections 54, 56, and 58.

Each shell section 18, 20 and 22 has an annular insulation layer 166 extending inwardly from its inner surface as best shown in FIGS. 3, 5, 6, 7, and 8. Each layer 166 is spaced from the outer surface of its respective liner 54, 56 or 58 by an annular gap 168. Gaps 168 allow liner sections 54, 56, and 58 room to expand outwardly when subjected to the heat of the burner flame. Cover 16 also has an insulation layer 170 disposed between the inner surface of the cover and the upper surface of lid portion 134, as best seen in FIGS. 3 and 5. Layer 170 generally surrounds burner 62. A lower insulation layer 172 is disposed below floor 68 and above base 14, as shown in FIG. 8. Insulation layers 166, 170, and 172 are preferably made of a ceramic wool type insulation.

Figure 1:
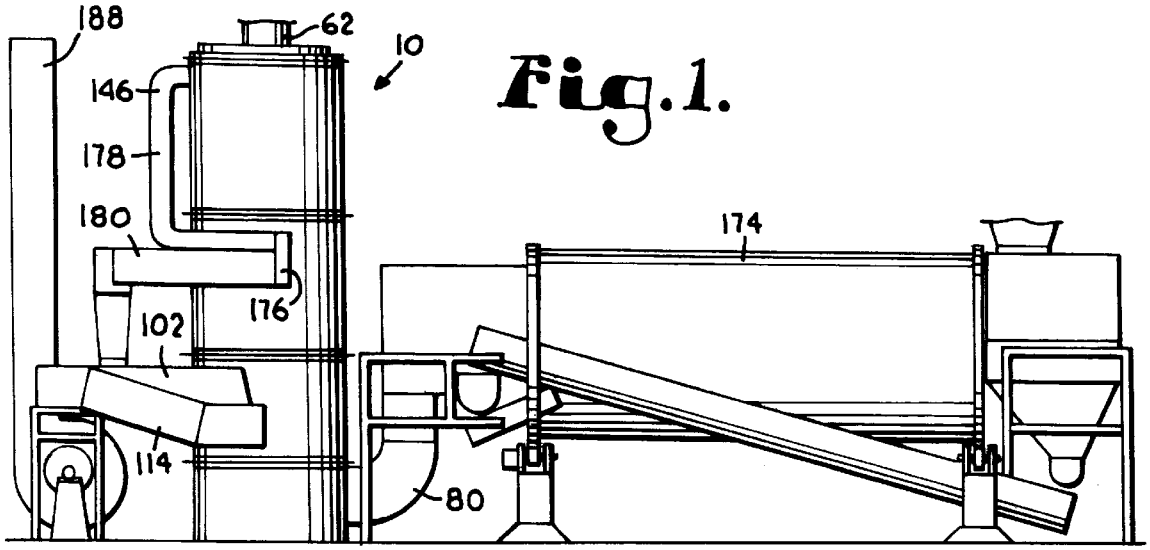
FIG. 1 is a diagrammatic view of a drying system utilizing a combustion chamber embodying the principles of the present invention.
Figure 12:
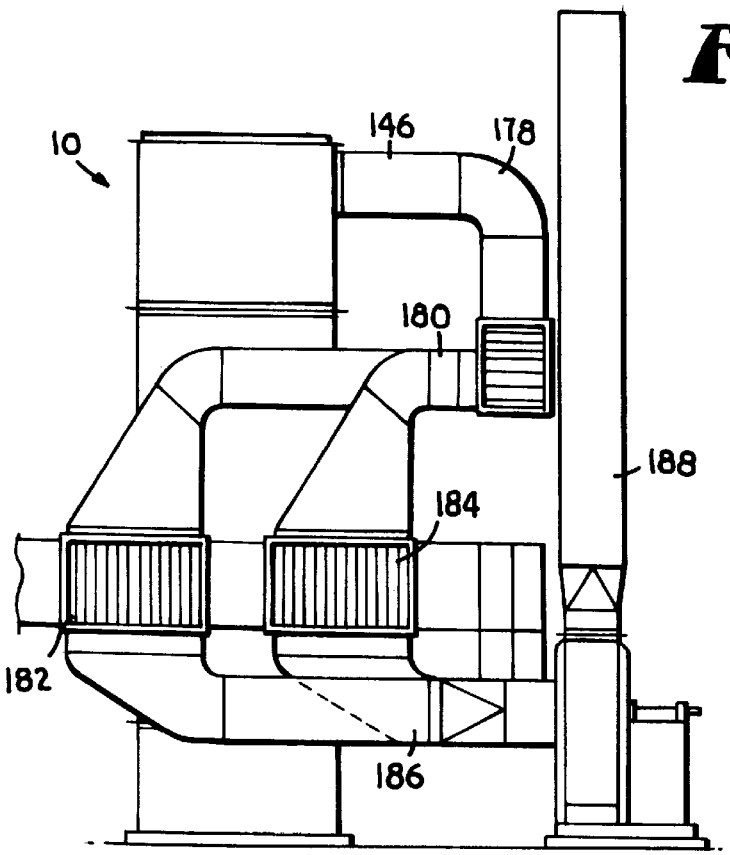
FIG. 12 is a partial diagrammatic elevational view of the drying system of FIG. 1.
Figure 13:
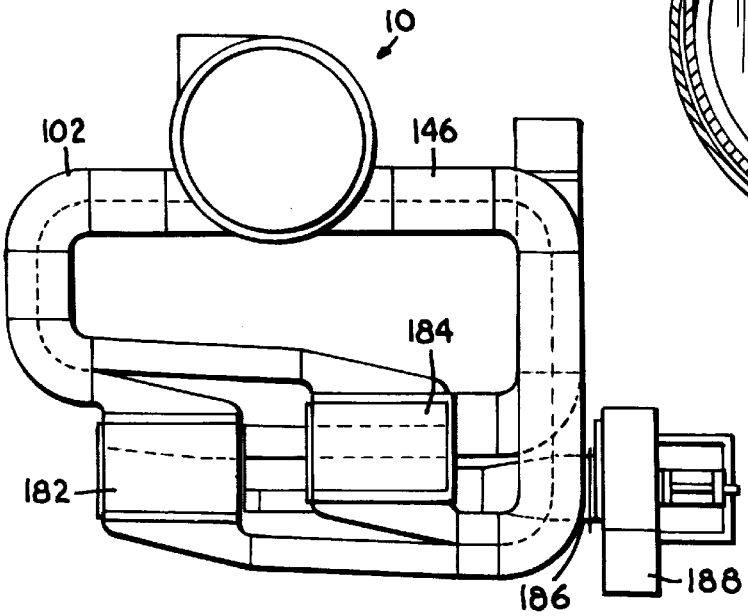
FIG. 13 is a partial top plan view of the drying system of FIG. 1.

In operation, burner 62 is supplied with fuel and combustion gases and burner 62 is lit to produce a flame within combustion area 60 as shown in FIG. 2. Gases from combustion area 60 are conveyed via dryer inlet duct 80 to a rotary dryer 174 as shown in FIG. 1. Within dryer 174 the stream of heated gases coming from the combustion chamber is exposed to the material to be dried. Thereafter, the dried material and the combustion gases are separated from one another by, for instance, a cyclone separator (not shown). At least a portion of the separated combustion gases are then conveyed back to the combustion chamber. More specifically, the separated gases are carried through a duct until they encounter a damper 176. Damper 176 divides the stream of heated gases into a first stream 178 and a second stream 180, as best seen in FIGS. 1 and 12. First stream 178 is conveyed to combustion chamber 10 through recycle gas duct 146 and inlet port 148. These gases will swirl within insert 138 and will eventually exit zone 140 and enter combustion area 60 through openings 150 and 158. The recycled gases exiting these openings form a circulating film around the burner flame which coats or wipes the inner surface of wall 142 as well as the inner surface of upper liner 58 and middle liner 56. Both swirling films of gases will mix with the combustion gases when insert 84 is encountered. More specifically, the recycled gases will encounter top plate 88 which forces the gases toward the center of combustion chamber 60 wherein the heated recycled gases are mixed with the newly combusted gases. A portion of the heated recycled gases are removed from combustion chamber 60 through adjustable ports 98. This portion of the heated recycled gas stream is thus conveyed to vent gas zone 96 and outward through vent gas duct 102 as best seen in FIGS. 9 and 13. The vent gases are then passed through a pair of heat exchangers 182 and 184. The vent gases passing through heat exchangers 182 and 184 are conveyed through a vent duct 186 and are then vented to the atmosphere through stack 188.

Figure 10:
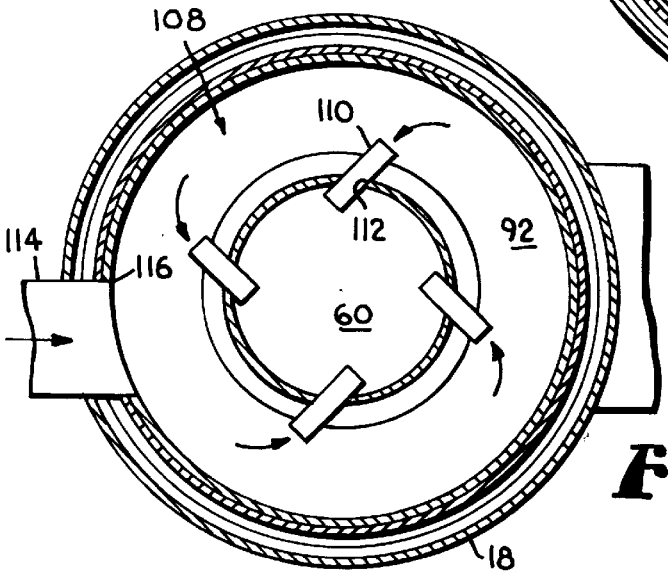
FIG. 10 is a detailed cross-sectional view taken generally along line 10—10 of FIG. 2 and showing the combustion chamber insert recycle introduction zone.

Second stream 180 of the recycled gases is conveyed through a second chamber of heat exchangers 182 and 184, as best seen in FIG. 12. After passing through the heat exchangers, the recycled gas is conveyed into recycled gas introduction zone 108 through recycled gas duct 114 as best seen in FIGS. 1 and 10. Exchangers 182 and 184 are thus used to exchange heat between the recycled gas stream and the heated recycled gas material exiting combustion chamber 60 at outlet port 104. The vent gases exiting through stack 188 may also be passed through a second heat exchanger prior to their removal. Passing through the second chamber of this heat exchanger (not shown) would be first stream 178.

The swirling film of recycled gases introduced by insert 138 along with the hanging structure of liners 56 and 58 allows the use of a less expensive and more easily manufactured material, such as stainless steel, as the construction material for the combustion chamber. More specifically, the swirling film of recycled gases adjacent the inner surface of the liner sections absorbs a great deal of the radiant energy being emitted by the burner flame. The recycled gases typically have a high water vapor content and a high carbon dioxide content and, thus, are very opaque. Therefore, a substantial amount of radiation emitted by the burner flame will be absorbed by the swirling film and will not pass through to the inner surface of the liners. Further, the wiping of the inner surface of the liners with the recycled gases enhances heat transfer between the liner sections and the gas film. Hence, at least a portion of the thermal energy found in the liners may be dissipated to the recycled gas stream. Further, the film of recycled gases, through absorption of thermal energy, reduces the pollutants found in the recycled gases through oxidation. Therefore, the provision of the swirling film of recycled gases serves a dual function in that it absorbs thermal energy that would normally pass through the liners, and further by absorbing this energy, pollutants found within the recycled gases are oxidized.

The unique structure of combustion chamber 10, and specifically insert 84, allows a portion of the heated recycled gases to be removed from combustion area 60. Heat exchangers 182 and 184 capture some of the heat in these gases prior to being vented to the atmosphere. Heat exchangers 182 and 184 also allow second stream 180 to be heated prior to being introduced into combustion area 60 through insert 84.

Adjustable ports 98 and 110 allow adjustment or manipulation of which portion of the recycled heated gas is removed from combustion area 60 and allow introduction of second stream 180 into a desired location within combustion area 60. More specifically, ports 98 and 110 can be adjusted so that the terminal edge of each port is further within combustion area 60. Sliding ports 98 and 110 inwardly will remove a different mixture and temperature of gases from combustion area 60. Conversely, ports 98 and 110 can be adjusted so that the terminal edge of each port is further removed from combustion area 60. Thus, the temperature of the gases exiting and entering the heat exchanger can be controlled to a degree.

From the foregoing, it will be seen that this invention is one well adapted to obtain all of the ends and objects hereinabove set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. A combustion chamber adapted to receive and process secondary gases, the chamber comprising:

a body having a first end and a second end, said body having an inner surface defining an inner combustion area, said body defining a first secondary gas introduction port disposed proximate said first end, an outlet port disposed proximate said second end for conveying heated gases from the combustion area, a secondary vent gas port disposed between said first secondary gas introduction port and said outlet port, and a second secondary gas introduction port disposed between said secondary vent gas port and said outlet, and;

a burner disposed adjacent said first end of said body so that the flame of said burner when lit will extend into said combustion area;

a first annular insert disposed in said combustion area proximate said first end and generally surrounding the flame of said burner when lit, said first insert defining a first secondary gas introduction zone in fluid communication with the first secondary gas introduction port for introducing secondary gases into said combustion area so that the secondary gases can be oxidized by the burner flame, said first insert having an annular inner surface having at least one opening for allowing fluid communication between said first secondary gas introduction zone and said combustion area;

a second annular insert disposed in said combustion area between said first insert and said outlet port, said second insert defining a secondary vent gas zone that is in fluid communication with the secondary vent gas port, said second insert further defining a second secondary gas introduction zone located between said vent gas zone and said outlet, said secondary gas introduction zone being in fluid communication with said secondary gas introduction port, said second insert having a divider plate separating the vent gas zone and the second secondary gas introduction zone, said second insert further having an annular inner wall separating said vent gas zone and said second secondary gas introduction zone from said combustion area, said inner wall of said second insert having a plurality of first openings spaced around said inner wall allowing fluid communication between said combustion area and said vent gas zone, and at least one second opening allowing fluid communication between said second secondary gas introduction zone and said combustion area; and a plurality of adjustable ports, said adjustable ports being disposed through said first openings, wherein secondary gases may be introduced into said combustion chamber for oxidation through said first annular insert, a portion of the secondary gases introduced through said first insert being removed from said chamber after oxidation through said vent gas zone and said first openings in said inner wall, another portion of the secondary gases may be introduced through said second secondary gas introduction port and the second secondary gas introduction zone, said secondary gases not removed by said vent gas zone and said gases introduced through said second secondary gas introduction zone exiting the combustion chamber through the outlet port.

2. The combustion chamber of claim 1, wherein said body has a longitudinal axis extending between said first end and said second end, and wherein said longitudinal axis is vertically oriented.

3. The combustion chamber of claim 1, wherein said inner wall of said second annular insert has a plurality of said second openings spaced around said inner wall.

4. The combustion chamber of claim 3, wherein a plurality of adjustable ports are disposed through said second openings.

5. The combustion chamber of claim 2, wherein said second insert has a generally horizontal annular top plate disposed above said divider plate, a generally horizontal annular bottom plate disposed below said divider plate, and a cylindrical outer wall coupled to said inner surface of said body between said top plate and said bottom plate, said top plate cooperating with said outer wall, said inner wall and said divider plate to define said secondary vent gas zone, said bottom plate cooperating with said outer wall said inner wall and said divider plate to define said second secondary gas introduction zone.

6. The combustion chamber of claim 5, wherein said inner wall disposed between said top plate and said divider plate forms a truncated cone having a larger diameter proximate said top plate than at said divider plate.

7. The combustion chamber of claim 6, wherein said inner wall disposed between said divider plate and said bottom plate forms a truncated cone having a diameter smaller at said divider plate than at said bottom plate.

8. The combustion chamber of claim 1 wherein said first annular insert and said second annular insert have a cylindrical shape.

9. The combustion chamber of claim 1 wherein said secondary gases are recycled gases.

10. A combustion chamber adapted to receive and process secondary gases, the chamber comprising:

a body having a first end and a second end, said body having an inner surface defining an inner combustion area, said body defining a first secondary gas introduction port disposed proximate said first end, an outlet port disposed proximate said second end for conveying heated gases from the combustion area, a secondary vent gas port disposed between said first secondary gas introduction port and said outlet port, and a second secondary gas introduction port disposed between said secondary vent gas port and said outlet;

a burner disposed adjacent said first end of said body so that the flame of said burner when lit will extend into said combustion area;

a first annular insert disposed in said combustion area proximate said first end and generally surrounding the flame of said burner when lit, said first insert defining a first secondary gas introduction zone in fluid communication with the first secondary gas introduction port for introducing secondary gases into said combustion area so that the secondary gases can be oxidized by the burner flame, said first insert having an annular inner surface having at least one opening for allowing fluid communication between said first secondary gas introduction zone and said combustion area; and a second annular insert disposed in said combustion area between said first insert and said outlet port, said second insert having a generally planar annular top plate, a generally planar annular bottom plate disposed between said top plate and said outlet port, a generally planar annular divider plate disposed between said top plate and said bottom plate, a cylindrical outer wall coupled said inner surface of said body between said top plate and said bottom plate, and an annular inner wall located radially inwardly from said outer wall and extending between said top plate and said bottom plate, said top plate cooperating with said outer wall, said inner wall and said divider plate to define a secondary vent gas zone, said bottom plate cooperating with said outer wall, said inner wall and said divider plate to define a second secondary gas introduction zone, said divider plate separating said vent gas zone and said second secondary gas introduction zone, said annular inner wall having at least one opening therein allowing fluid communication between said combustion area and said vent gas zone, said annular inner wall further having at least one opening therein allowing fluid communication between said combustion area and said second secondary gas introduction zone;

wherein said vent gas zone is in fluid communication with said vent gas port, and said second secondary gas introduction zone is in fluid communication with said second secondary gas introduction port;

wherein secondary gases may be introduced into said combustion chamber for oxidation through said first annular insert, a portion of the secondary gases introduced through said first insert being removed from said chamber after oxidation through said vent gas zone and the vent gas port, another portion of the secondary gases may be introduced through said second secondary gas introduction port and the second secondary gas introduction zone, said secondary gases not removed by said vent gas zone and said gases introduced through said second secondary gas introduction zone exiting the combustion chamber through the outlet port.

11. The combustion chamber of claim 10, wherein said body has a longitudinal axis extending between said first end and said second end, and wherein said longitudinal axis is vertically oriented.

12. The combustion chamber of claim 11, wherein said inner wall of said second annular insert has a plurality of said first openings spaced around said inner wall.

13. The combustion chamber of claim 10, wherein a plurality of adjustable ports are disposed through said first openings.

14. The combustion chamber of claim 10 wherein said inner wall of said second annular insert has a plurality of said second openings spaced around said inner wall.

15. The combustion chamber of claim 14, wherein a plurality of adjustable ports are disposed through said second openings.

16. The combustion chamber of claim 10, wherein said inner wall disposed between said top plate and said divider plate forms a truncated cone having a larger diameter proximate said top plate than at said divider plate.

17. The combustion chamber of claim 16, wherein said inner wall disposed between said divider plate and said bottom plate forms a truncated cone having a diameter smaller at said divider plate than at said bottom plate.

18. A combustion chamber including an insert, the chamber having an inner combustion area defined by an inner surface, said inner surface having a vent gas port and a secondary gas introduction port, the chamber adapted to receive and process secondary gases, the insert comprising:

a generally horizontal annular bottom plate coupled to said inner surface of the combustion chamber;

a generally horizontal annular divider plate disposed above said bottom plate, said divider plate being coupled to said inner surface of the combustion chamber;

a generally horizontal annular top plate disposed above said divider plate, said top plate being coupled to said inner surface of the combustion chamber; and an annular inner wall located radially inwardly from said inner surface and extending between said top plate and said bottom plate, said inner wall cooperating with said inner surface, said top plate and said divider plate to define a secondary vent gas zone, said inner wall cooperating with said inner surface, said divider plate and said bottom plate to define a secondary gas introduction zone, said divider plate separating said vent gas zone and said secondary gas introduction zone;

wherein said annular inner wall has at least one first opening therein allowing fluid communication between said combustion and said vent gas zone, said annular inner wall further having at least one second opening therein allowing fluid communication between said combustion area and said second secondary gas introduction zone;

wherein said vent gas zone is in fluid communication with the vent gas port, and said secondary gas introduction zone is in fluid communication with said secondary gas introduction port;

wherein secondary gases may be introduced into said combustion chamber for oxidation and a portion of the secondary gases introduced can be removed from said chamber after oxidation through the vent gas zone and the vent gas port, another portion of secondary gases may be introduced through said secondary gas introduction port and the secondary gas introduction zone.

19. The combustion chamber of claim 18 wherein said inner wall presents a plurality of said first openings spaced around said inner wall.

20. The combustion chamber of claim 19, wherein a plurality of adjustable ports are disposed through said first openings.

21. The combustion chamber of claim 20, wherein said inner wall presents a plurality of said second openings spaced around said inner wall.

22. The combustion chamber of claim 21, wherein a plurality of adjustable ports are disposed through said second openings.

23. The combustion chamber of claim 18, wherein said inner wall disposed between said top plate and said divider plate forms a truncated cone having a larger diameter proximate said top plate than at said divider plate.

24. The combustion chamber of claim 23, wherein said inner wall disposed between said divider plate and said bottom plate forms a truncated cone having a diameter smaller at said divider plate than at said bottom plate.

* * * * *